US007576324B2

(12) United States Patent
Grossenbacher et al.

(10) Patent No.: US 7,576,324 B2
(45) Date of Patent: Aug. 18, 2009

(54) ION DETECTION METHODS, MASS SPECTROMETRY ANALYSIS METHODS, AND MASS SPECTROMETRY INSTRUMENT CIRCUITRY

(75) Inventors: John W. Grossenbacher, Lafayette, IN (US); Garth E. Patterson, Brookston, IN (US)

(73) Assignee: Griffin Analytical Technologies, L.L.C., West Lafayette, IN (US)

( * ) Notice: Subject to any disclaimer, the term of this patent is extended or adjusted under 35 U.S.C. 154(b) by 487 days.

(21) Appl. No.: 10/570,717

(22) PCT Filed: Sep. 3, 2004

(86) PCT No.: PCT/US2004/029127

§ 371 (c)(1),
(2), (4) Date: Mar. 2, 2006

(87) PCT Pub. No.: WO2005/024882

PCT Pub. Date: Mar. 17, 2005

(65) Prior Publication Data

US 2007/0057176 A1 Mar. 15, 2007

Related U.S. Application Data

(60) Provisional application No. 60/500,543, filed on Sep. 5, 2003.

(51) Int. Cl.
*H01J 49/42* (2006.01)

(52) U.S. Cl. ..... 250/292; 250/281; 250/282; 250/283; 250/397

(58) Field of Classification Search ..... 250/281, 250/397, 283, 423 R
See application file for complete search history.

(56) References Cited

U.S. PATENT DOCUMENTS 4,423,324 A 12/1983 Stafford
4,766,312 A 8/1988 Fergusson et al.
4,810,882 A 3/1989 Bateman (Continued)

OTHER PUBLICATIONS

International Search Report (PCT/US04/29127, filed Sep. 3, 2004).

(Continued)

*Primary Examiner*—Nikita Wells
*Assistant Examiner*—Johnnie L Smith
(74) *Attorney, Agent, or Firm*—Wells St. John P.S.

(57) ABSTRACT

Ion detection methods are provided that can include applying a first voltage between a power source and a dynode, and contacting the dynode with first ions to create a first charged species. After applying the first voltage, a second voltage can be applied between the power source and the dynode, and the dynode can be contacted with second ions to create a second charged species. Mass spectrometry instrument circuitry is also provided that can include a power source coupled to a dynode via at least one switch with the switch being operatively configured in one position to apply a first voltage between the dynode and the power source, and, in another position, configured to apply a second voltage between the dynode and the power source. Mass spectrometry analysis methods are also provided that can include detecting sorted ions using a dynode configured according to an ion detection parameter with the ion detection parameter including first and second dynode values associated with first and second time values. Methods and circuitry for portable instrumentation are also provided.

13 Claims, 5 Drawing Sheets

U.S. PATENT DOCUMENTS

| | | | | |
|---|---|---|---|---|
| 4,988,867 | A | 1/1991 | Laprade | |
| 4,996,422 | A | 2/1991 | Mitsui et al. | |
| 5,202,561 | A * | 4/1993 | Giessmann et al. | 250/281 |
| 5,401,965 | A | 3/1995 | Kaneko et al. | |
| 5,481,107 | A * | 1/1996 | Takada et al. | 250/281 |
| 5,773,822 | A * | 6/1998 | Kitamura et al. | 250/281 |
| 5,852,295 | A * | 12/1998 | Da Silveira et al. | 250/423 R |
| 6,025,590 | A * | 2/2000 | Itoi | 250/281 |
| 6,737,644 | B2 | 5/2004 | Itoi | |
| 6,861,650 | B2 | 3/2005 | Kondo et al. | |
| 7,026,177 | B2 * | 4/2006 | Laprade | 438/20 |
| 7,047,144 | B2 * | 5/2006 | Steiner | 702/64 |
| 7,294,832 | B2 * | 11/2007 | Wells et al. | 250/292 |
| 2002/0195556 | A1 * | 12/2002 | Yoshinari et al. | 250/283 |
| 2006/0231769 | A1 * | 10/2006 | Stresau et al. | 250/397 |

OTHER PUBLICATIONS

Written Opinion of International Searching Authority (PCT/US04/29127, filed Sep. 3, 2004).

* cited by examiner

ION DETECTION METHODS, MASS SPECTROMETRY ANALYSIS METHODS, AND MASS SPECTROMETRY INSTRUMENT CIRCUITRY

CLAIM FOR PRIORITY

This application claims priority to U.S. provisional patent application Ser. No. 60/500,543 filed Sep. 5, 2003, entitled "Analysis Methods and Devices", the entirety of which is hereby incorporated by reference.

RELATED PATENT DATA

This application is a 35 U.S.C. §371 of and claims priority to PCT International Application Number PCT/US04/129127, which was filed 3 Sep. 2004, and was published in English, which claims priority under 35 U.S.C. §119 to U.S. Provisional Patent Application No. 60/500,543 which was filed 5 Sep. 2003, the entirety of each are incorporated herein by reference.

GOVERNMENT RIGHTS STATEMENT

This invention was made with Government support under SBIR Phase II Contract DABJ19-03-C0001 awarded by the United States Army. The Government has certain rights in the invention.

TECHNICAL FIELD

The present disclosure relates generally to instrumentation, ion detection methods, mass spectrometry analysis methods, and mass spectrometry instrument circuitry.

BACKGROUND ART

Mass spectrometry is a valuable analytical technique that may be used to determine the structures of a wide variety of complex chemical species. In particular aspects, this analytical technique may also be utilized to determine the quantity of chemical species as well. Mass spectrometry can also be utilized to provide high-speed analysis of complex mixtures enhancing capacity for structure elucidation. High-capacity and high-speed analysis can be two important factors in analytical instrumentation.

Mass spectrometers can be configured to ionize a sample and produce positive and/or negative ions which are typically filtered with the aid of a mass analyzer before being detected by a sensor configured to detect ions having specific polarities. Instruments that are capable of detecting both positively charged and negatively charged analytes are desirable. For example, U.S. Pat. No. 4,810,882 to Bateman describes methods and apparatuses for detecting both positive and negative ions using two different electrodes each having their own power supply, and the teachings of Bateman are hereby incorporated by reference. U.S. Pat. No. 4,966,422 to Mitsui et al. describes the detection of both positive and negative analytes using two detectors, and the teachings of Mitsui are hereby incorporated by reference.

Recently, mass spectrometry instruments are being miniaturized for the purposes of operating the instruments in the field. Miniaturizing instruments in this fashion allows users to perform analysis actually at the sample site, which can alleviate difficulties often associated with sample preparation and transport, and thereby reduce errors in analysis. One of the challenges faced when miniaturizing a mass spectrometer is manufacturing a device that is compact yet versatile.

Aspects of this disclosure provide ion detection methods, mass spectrometry analysis methods, and mass spectrometry instrument circuitry.

SUMMARY

Ion detection methods are provided that can include providing a detector being operatively aligned to receive charged species from a dynode operatively aligned to receive both first and second ions. A first voltage can be applied between the dynode's power source and the dynode, in one aspect, and the dynode can be contacted with the first ions to create a first charged species. According to one embodiment, after applying the first voltage, a second voltage, not equaling the first voltage, can be applied between the power source and the dynode, and the dynode can be contacted with the second ions to create a second charged species.

Mass spectrometry instrument circuitry is provided that can include a power source coupled to a dynode via at least one switch operatively configured in one position to apply a first voltage between the dynode and the power source, and, in another position, to apply a second voltage between the dynode and the power source.

Mass spectrometry analysis methods are also provided that can include ionizing a sample to form both first and second ions according to an ionization parameter and sorting the ions by mass-to-charge ratio according to a mass separation parameter. Methods also provide for detecting the sorted ions using a dynode configured according to an ion detection parameter including first and second dynode values associated with first and second time values. The detecting can also include acquiring a sample data set comprising a first abundance of ions acquired during the first time value and a second abundance of ions acquired during the second time value. Embodiments of the methods and circuitry described can be utilized in and/or by mass spectrometry instrumentation and, in particular embodiments, this instrumentation can be used in the field.

BRIEF DESCRIPTION OF THE DRAWINGS

Aspects of the disclosure are described below with reference to the following accompanying drawings.

DETAILED DESCRIPTION OF THE PREFERRED EMBODIMENTS

In one embodiment mass spectrometry analysis methods are provided that include ionizing a sample to form both first and second ions according to an ionization parameter, with the first and second ions having different mass-to-charge ratios. These ions can then be sorted by their mass-to-charge ratio according to a mass separation parameter, and the sorted ions can subsequently be detected using a dynode configured according to an ion detection parameter. In one embodiment the ion detection parameter can include first and second dynode values associated with first and second time values. In this embodiment the detecting can comprise acquiring a sample data set that includes a first abundance of ions acquired during the first time value, and a second abundance of ions acquired during the second time value. Methods such as these can be performed utilizing instrumentation described herein.

In particular implementations, the combination of a dynode and a multiplier (detector) can be configured for use in field portable instruments. It can be advantageous, particularly during field applications, to detect both positive and negative ions and thereby provide a more complete range of analytical flexibility. In particular embodiments the methods and/or circuitry described can be utilized by an instrument that occupies the least amount of space practical such as a portable or field portable instrument that has dedicated power sources and components for use in applications outside the laboratory. Exemplary field portable instruments can be those instruments that weigh less than about 60 lbs. In other embodiments, field portable instruments include those instruments that are the general size and configuration of a suitcase. And in still other embodiments, field portable instruments can be those instruments that utilize less than 500 Watts of electrical power during periods of peak power demand.

Figure 1:
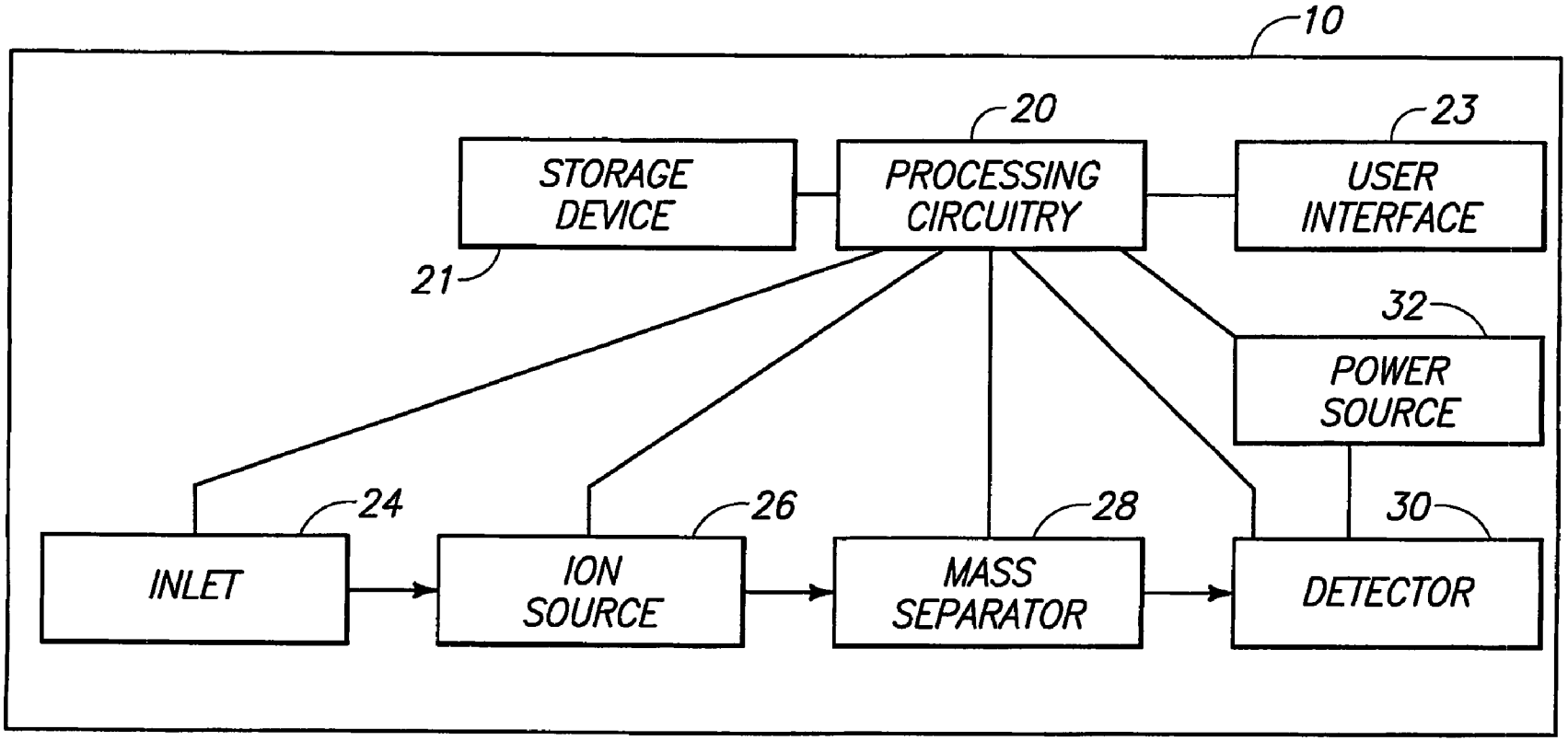
FIG. 1 is a block diagram of an instrument according to one embodiment.

Referring first to FIG. 1, an analytical instrument 10, in accordance with one embodiment, includes processing circuitry 20, a storage device 21, user interface 23, an inlet 24, an ion source 26, a mass separator 28, an ion detector 30, and a power source 32. In one implementation analytical instrument 10 is configured to perform mass spectrometry analysis operations. Other embodiments are possible including alternative components in combination with more or less of the components described herein. Exemplary subject samples include inorganic and organic substances in solid, liquid, and/or vapor form. Specific samples suitable for analysis include volatile compounds such as toluene, semi-volatile compounds such as methyl salicylate, and/or more highly complex non-volatile protein-based structures such as bradykinin. The samples can be a mixture containing any number of substances or in other aspects samples can be of a substantially pure substance.

Processing circuitry 20 may be implemented as a processor or other structure configured to execute executable instructions including, for example, software and/or firmware instructions. Other exemplary embodiments of processing circuitry 20 include hardware logic, PGA, FPGA, ASIC, and/or other structures. These examples of processing circuitry 20 are for illustration and other configurations are possible. In the exemplary embodiment of FIG. 1, circuitry 20 is coupled to storage device 21 and user interface 23.

Storage device 21 can be configured to store electronic data and/or programming such as executable instructions (e.g. software and/or firmware), data, and/or other digital information and may include processor-usable media. Processor-usable media includes any article of manufacture which can contain, store, and/or maintain programming data and/or digital information for use by, and/or in connection with, an instruction execution system including processing circuitry 20, in an exemplary embodiment. For example, exemplary processor-usable media may include physical media such as electronic, magnetic, optical, electromagnetic, infrared and/or semiconductor media. Some more specific examples of processor-usable medium include, but are not limited to, a portable magnetic computer diskette such as a floppy diskette, zip disk, hard drive, random access memory, read only memory, flash memory, cache memory and/or other configurations capable of storing programming, data, and/or other digital information.

User interface 23 can be any interface that allows user manipulation and/or control of instrument 10 and/or provides status information. Exemplary user interfaces include keyboards, monitors, touch-screens, web-based servers, and/or voice activated media.

Processing circuitry 20, in combination with user interface 23, and/or storage device 21, can be configured to control inlet 24, ion source 26, mass separator 28, detector 30, and/or power source 32 to implement analysis operations of instrument 10. Processing circuitry 20, in combination with user interface 23 and/or storage device 21, can provide, in certain embodiments, inlet, ionization, mass separation, and/or detection parameters, to inlet 24, ion source 26, mass separator 28, detector 30, and/or power source 32.

Inlet 24 can be configured to introduce a sample for analysis according to inlet parameters. Exemplary inlets 24 include, but are not limited to, batch inlets, direct probe inlets, chromatographic inlets, permeable and/or capillary membrane inlets. Other configurations are possible. Inlet parameters can include values such as chromatographic values. In the context of gas chromatography, for example, these inlet parameters can include, but are not limited to, column type, length, and/or temperature ramp. Inlet parameters can also include capillary membrane inlet types and/or temperatures, for example. Additional inlet parameters can include a time value associated with other inlet parameters. For example, and by way of example only, a time value can be associated with an inlet parameter such as column temperature in the instance of gas chromatography, or liquid phase composition in the instance of liquid chromatography. Inlet 24 can be configured to receive inlet parameters from circuitry 20 and provide sample to ion source 26.

Ion source 26 is coupled to inlet 24 and configured to receive the sample from inlet 24. Ion source 26 is configured to convert components of the sample into ions. Exemplary conversion operations may be implemented by bombarding the sample with electrons, ions, molecules, and/or photons. Conversion operations can also include applying thermal and/or electrical energy. Ion source 26 may be configured to produce ions with positive and/or negative charges and/or different mass-to-charge ratios. For example, sample may be bombarded with a known chemical species to generate ions having a negative charge and/or sample may be bombarded with electrons to generate ions having a positive charge. Samples may also be bombarded with chemical species to generate both positively and negatively charged ions. Other conversion operations are possible. Ion source 26 may be configured according to ionization parameters that include values such as: the amount and type of energy provided to the sample to form ions; the compositions or chemical ionization applied to the sample to form ions; and/or a time value associated with providing this ionization parameter. In one embodiment the ionization parameter can be associated with other instrument parameters. For example, a time value ionization parameter can be associated with a time value inlet parameter, such as the one described above. Ions from ion source 26 can be provided to mass separator 28.

Exemplary mass separators 28 can include mass separators such as magnetic sectors, electrostatic sectors, quadrupole filter sectors, quadrupole ion traps, electrical ion traps, Kingdon traps, linear quadrupole ion traps, ion cyclotron resonance, quadrupole ion trap/time of flight mass spectrometers, rectilinear ion traps and/or cylindrical ion traps (CIT). For example, CITs typically include three components: a trapping volume; and two endcaps. Typically an AC current or RF voltage is applied to the trapping volume at a predefined rate to eject trapped analytes which are subsequently detected. RF voltage ramps may include variables such as voltage and/or frequency. Combinations of these variables and predefined amounts are typically referred to as waveforms, and waveforms are just one of the many separation parameters that can be applied to mass separator 28. Generally, waveforms can be optimized to increase detection of specific analytes of interest such as the ions formed utilizing ion source 26 according to ionization parameters. Waveforms can also be optimized to allow for multiple stages of mass analysis, for example analyses such as tandem mass spectrometry.

For example, and by way of example only, ions formed using ion source 26 can be sorted by their mass-to-charge ratio according to a mass separation parameter that includes waveforms. This mass separation parameter may also be associated with a time value such as a time value that is also associated with acquisition parameters such as inlet, ionization, and/or detection parameters. By way of example, an ionization parameter that includes values such as a first time value and a first electron impact energy can be associated with a mass separation parameter that has the same first time value associated with a waveform. As stored in storage device 21, processing circuitry 20 can apply these parameters to both ion source 26 and mass separator 28 and thereby associate the application of electron impact energy applied by ion source 26 with the waveform applied by mass separator 28. Device 21 and processing circuitry 20 can also be utilized to associate detection parameters of detector 30.

Detector 30 can be configured to receive analytes from mass separator 28. Exemplary detectors include electron multipliers, Faraday cup collectors, photographic and scintillation type detectors. Detector 30 can also include a dynode (not shown in FIG. 1) to convert ions, formed utilizing ion source 26 and received from mass separator 28, into charged species. During exemplary operation of detector 30, ions are received from mass separator 28 by the dynode resulting in the ejection of charged species. The charged species may then be detected using a single detector such as an electron multiplier or a combination of detectors such as a scintillation/photomultiplier combination. Detector 30 can be powered by power source 32.

Power source 32 can include portable and/or stationary power sources (AC or DC). However, where instrument 10 is a portable or field system, power source 32 can be a portable source such as a battery. Power source 32 can include two separate, single-channel, ground-referenced power supplies; a single, dual-channel, ground referenced power supply; and/or a single, dual-channel floating (i.e. not referenced to ground potential) power supply.

Figure 2A:
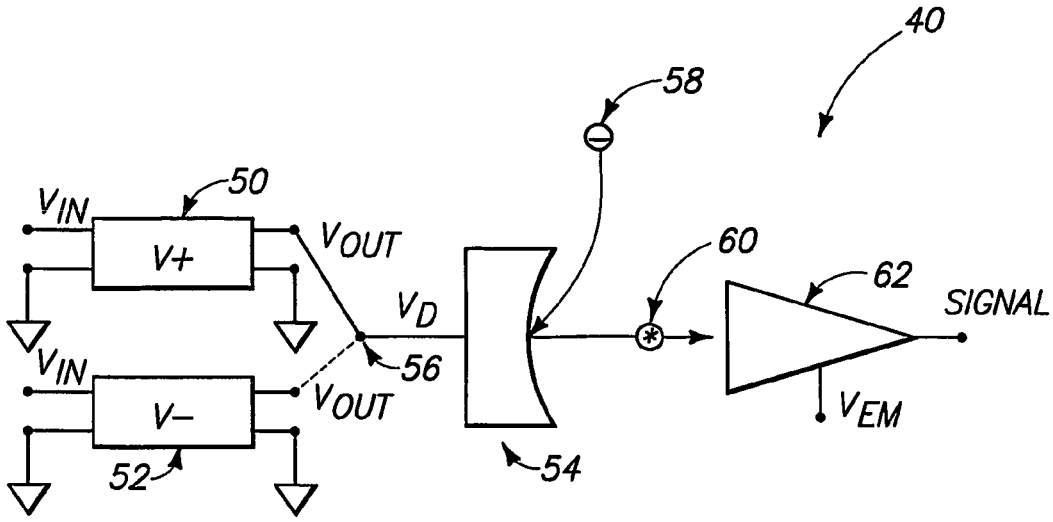
FIG. 2*a* is a detector diagram according to one embodiment.
Figure 2B:
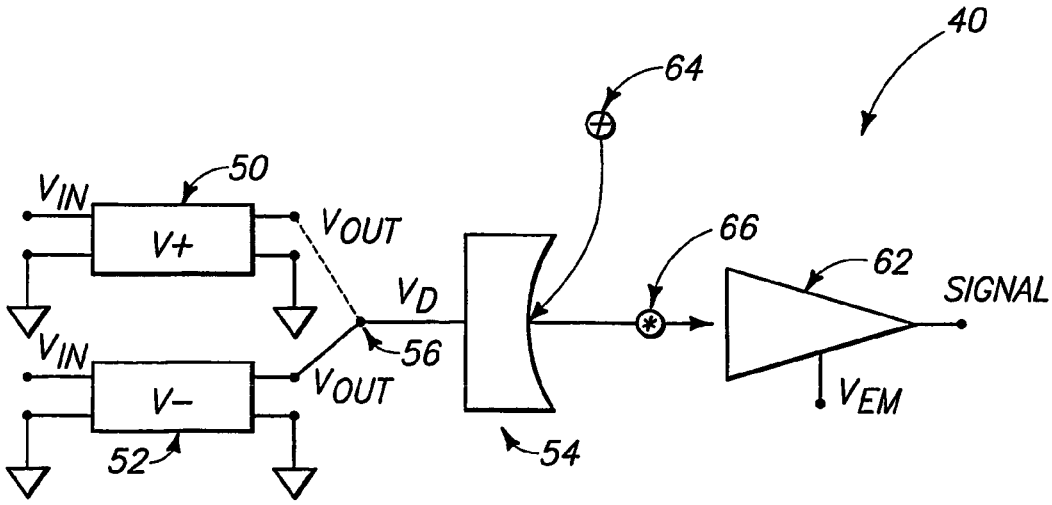
FIG. 2*b* is a detector diagram according to one embodiment.

Referring to FIGS. 2*a* and 2*b*, an aspect of the disclosure provides mass spectrometry circuitry that, in one embodiment, can be utilized to detect ions having different polarities. Instrument circuitry 40 includes power supplies 50 and 52 coupled via switch 56 to a dynode 54 configured to receive a negatively charged ion 58, in exemplary embodiments, from a mass separator and/or ion source. In exemplary aspects switch 56 can be controlled by processing circuitry 20. Switch 56 may be embodied as a relay in one exemplary configuration. Circuitry 40 can be configured to eject charged species 60 from dynode 54 to an exemplary detector 62. Detector 62 can be configured to have, in certain embodiments, a predefined voltage applied thereto when detector 62 is configured as an electron multiplier.

As depicted in FIG. 2*a*, providing a positive power supply 50 to dynode 54 results in detector 62 being in a negative ion detection mode. In exemplary embodiments a first voltage is applied between power supply 50 and dynode 54. This first voltage can include a positive voltage or a voltage greater than zero. In this mode, negative ion 58 generated, for example, by ion source 26 (FIG. 1) and provided through mass separator 28 (FIG. 1) can be converted to a charged species 60 which can be detected by an exemplary detector 62. Detector 62 can be configured to provide a signal that can be received by process circuitry 20 and, in exemplary embodiments, stored in storage device 21.

Alternatively, as depicted in FIG. 2*b*, circuitry 40 can be configured for positive ion detection. As illustrated in FIG. 2*b* negative power supply 52 is coupled to dynode 54 via switch 56. In this mode when a positive ion 64 is received by dynode 54 a charged species 66 can be detected by detector 62. This signal as provided above can be provided to process circuitry 20. In one aspect, a negative voltage can be applied according to the configuration depicted in FIG. 2*b* by coupling dynode 54 to negative power supply via switch 56.

In accordance with the present invention, detection parameters can include values associated with time that dictate the providing of positive voltage between power supply 50 and dynode 54 and at alternative times dictate the providing of negative voltage between dynode 54 and power supply 52. In accordance with the present invention these parameters can be associated via their time values with mass separation parameters, ionization parameters, and/or inlet parameters as the user defines.

Figure 3A:
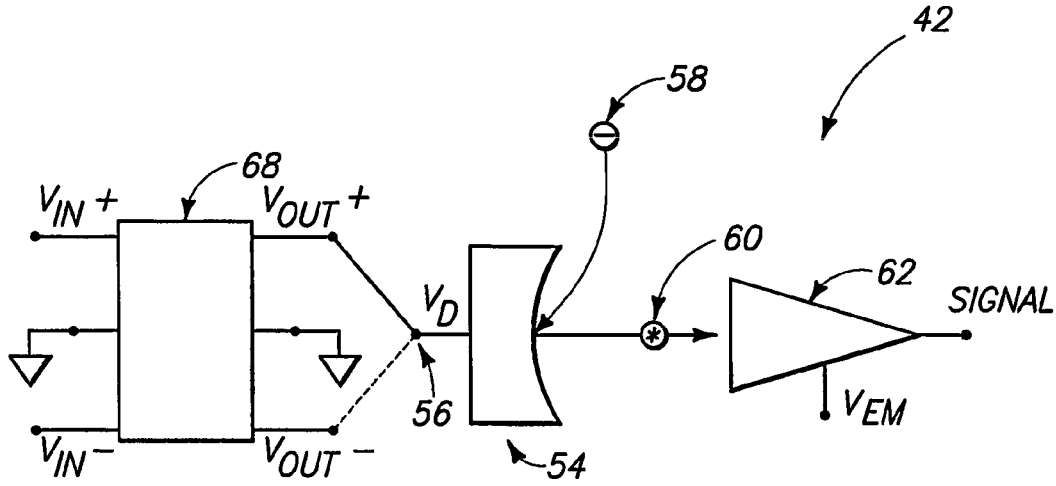
FIG. 3*a* is a detector diagram according to one embodiment.
Figure 3B:
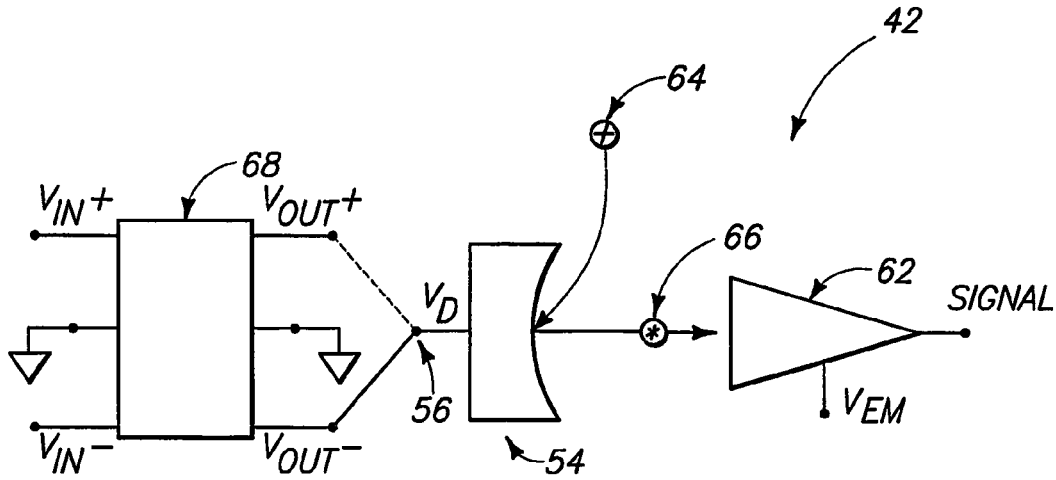
FIG. 3*b* is a detector diagram according to one embodiment.

Referring to FIGS. 3*a* and 3*b*, process circuitry 42 is depicted as exemplarily configured using a single power supply 68. Power supply 68 can be a single, dual-channel ground-referenced power supply with a positive output terminal and a negative output terminal for powering dynode 54 via switch 56. In the exemplary configuration depicted in FIG. 3*a*, the positive output terminal of power supply 68 is connected to dynode 54 via switch 56. Configured as depicted in FIG. 3*a*, detector 62 is in negative ion detection mode. In this mode negative ion 58 can be converted to charged species 60 which can be detected by exemplary detector 62. In the alternative exemplary configuration of FIG. 3*b*, the negative output terminal of power supply 68 is connected to dynode 54. In this configuration positive ion 64 can be received by dynode 54 emitting charged species 66 which can be detected by exemplary detector 62.

Figure 4A:
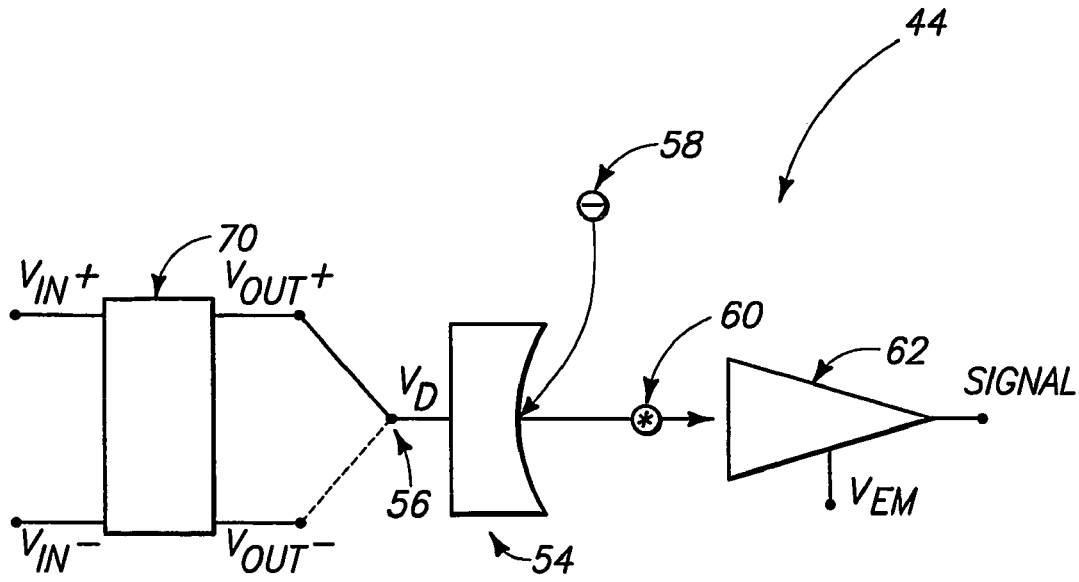
FIG. 4*a* is a detector diagram according to one embodiment.
Figure 4B:
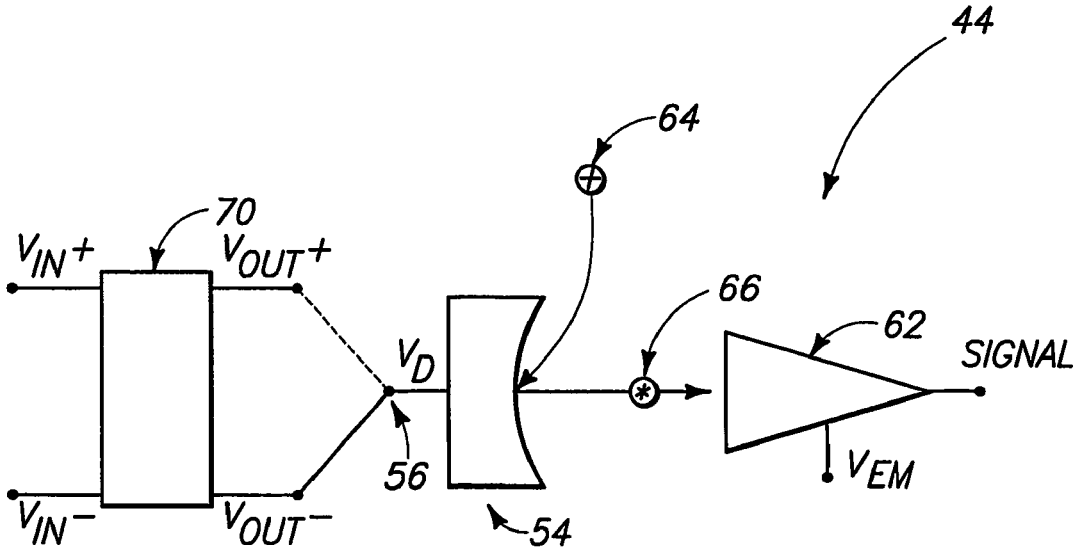
FIG. 4*b* is a detector diagram according to one embodiment.

According to another aspect of the disclosure, circuitry 44 is depicted in FIG. 4*b* utilizing a floating (i.e. not referenced to ground potential) power supply 70 according to the exemplary configuration. Power supply 70 includes an output of each polarity. At least some aspects of this configuration can offer the flexibility of allowing the positive and negative voltages to be set relative to ground, i.e. floated, to provide different voltage levels as instrument conditions warrant.

Referring to FIG. 4*a*, the positive output terminal of power supply 70 can be connected to dynode 54 via switch 56. The illustrated configuration of FIG. 4*a* can provide a positive voltage to dynode 54 resulting in detector 62 being in negative detection mode. In this mode a negative ion 58 can be converted to charged species 60 which can be detected by exemplary detector 62. In an alternative configuration, FIG. 4*b* illustrates the set up for positive ion detection. As depicted in FIG. 4*b*, the negative terminal of power supply 70 provides a negative voltage to dynode 54. In this exemplary configuration positive ions 64 can be received by dynode 54 and charged species 66 can be generated which can be detected by exemplary detector 62.

In exemplary embodiments the voltage between the dynode and the power source can be referenced to the ions being detected. For example, where the ions are generated at what may be considered a high voltage, the dynode may be grounded.

The detection of charged species 60 can be utilized to generate analytical data that includes an abundance of the charged species detected associated with the voltage applied between power source 32 and dynode 54 of detector 30. In certain aspects this analytical data can be associated with a time value that is likewise associated with time values of detection, mass separation, ionization, and/or inlet parameters. Referring again to FIGS. 2-4, switch 56 can be controlled by processing circuitry 20 and may be embodied as a relay in one exemplary configuration. In these configurations switch 56 is configured in one position to apply a first voltage between the dynode and the power source and in another position to apply second voltage between the dynode and the power source. As exemplarily depicted in FIGS. 2-4 the voltage between the power source and the dynode in one position can be greater than zero and in another position can be less than zero. In the one position the dynode is configured to eject charged species upon receipt of negatively charged ions and in the other position the dynode is configured to eject charged species upon receipt of positively charged ions, in one embodiment.

As described above the detection parameter can include first and second dynode values associated with first and second time values. In exemplary embodiments the dynode values can include the voltage applied between the power source and the dynode, and the dynode can be configured to receive negatively charged ions and eject a charged species and/or configured to receive positively charged ions and eject a charged species. As described above, in exemplary embodiments, the dynode values do not equal each other. For example, the first dynode value can be greater than zero and a second dynode value can be less than zero. As exemplarily described above, ions detected during first time values can comprise negatively charged ions and ions detected during second time values can comprise positively charged ions.

Detection parameters can also provide for turning the dynode and/or the detector off during a time value and turning the dynode and/or the detector on during another time value. These time values can be coordinated with the time values associated with other acquisition parameters. For example, these time values can correspond to time values of the mass separation parameters described above. In exemplary embodiments, when associated with mass separation parameters, turning the dynode and/or detector off during a time value that is associated with a mass separation parameter that provides a large flux of ions can extend the useful life of the dynode and/or detector.

In exemplary implementations, applying these parameter values to instrument 10, as described above, can provide for the acquisition of analytical data that is specific to these acquisition parameters. For example, and by way of example only, data of known samples can be acquired in accordance with acquisition parameters and utilized as standard data. Data of unknown samples can be acquired in accordance with the same acquisition parameters used to acquire the standard data and then cross referenced by known algorithms to determine qualitative and quantitative amounts of the known sample present in the unknowns analyzed.

For example, a first set of acquisition parameters can be provided to instrument 10 and a known sample analyzed under these acquisition parameters. This known sample will provide standard data that can be associated with the known sample. Exemplary data includes mass spectrometry data. An unknown sample can also be provided and this sample can be analyzed using these first acquisition parameters. The data acquired by analyzing this unknown sample according to these first acquisition parameters can then be compared with the standard data and a percent match determined according to known mass spectrometry algorithms. In exemplary embodiments, databases of known sample data acquired utilizing acquisition parameters can be stored in storage device 21 and each one of the data associated with these known samples can be compared to unknown data acquired using acquisition parameters corresponding to those used to acquire the known sample data. These types of analyses are exemplary of analyses that can be utilized to determine both quantitative and qualitative data.

Figure 5A:
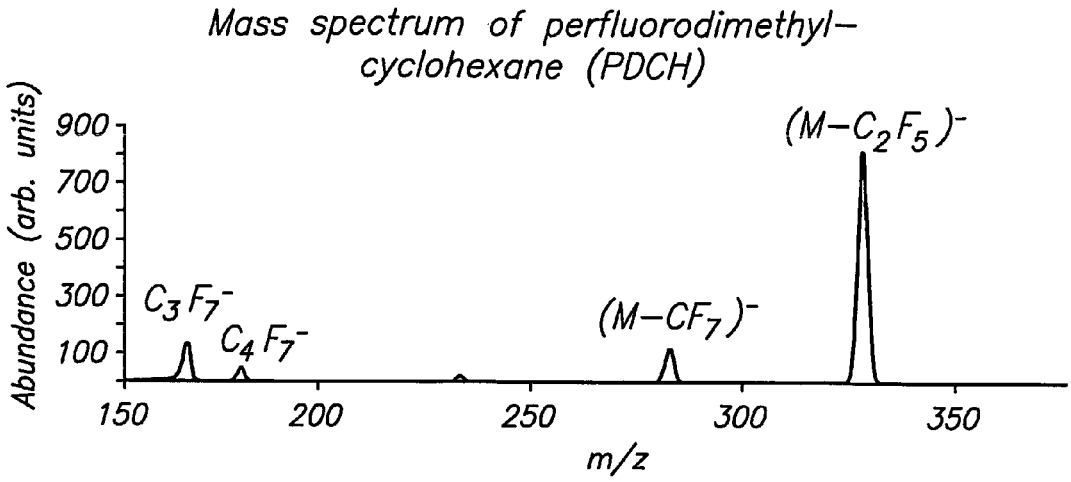
FIG. 5*a* is data acquired according to one embodiment.
Figure 5B:
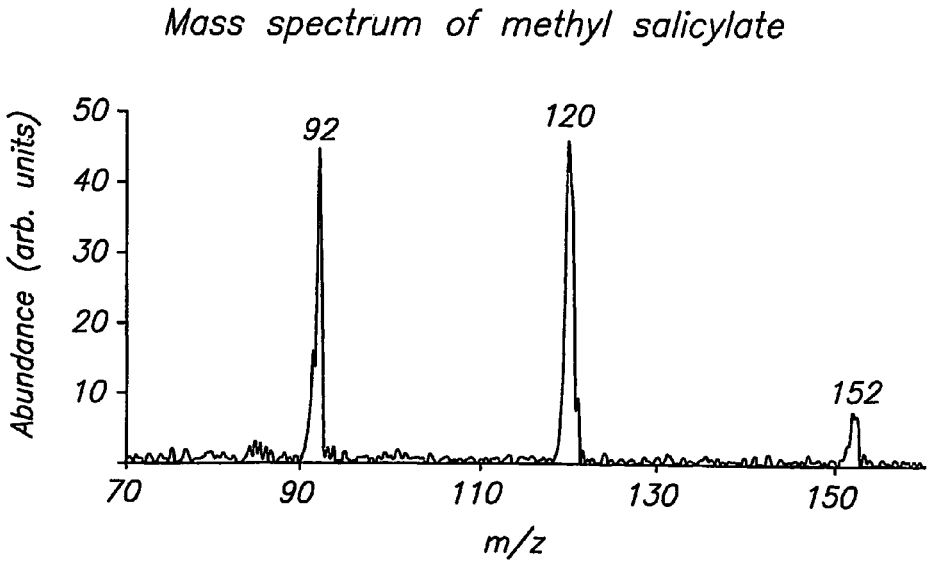
FIG. 5*b* is data acquired according to one embodiment.

Referring to FIGS. 5*a* and 5*b* exemplary data are shown that is acquired using embodiments of methods and circuitry described. For example, FIG. 5*a* represents the mass spectrum of perfluorodimethylcyclohexane (PDCH) acquired using methods and/or circuitry configured as described in the negative ion detection mode, see e.g., FIGS. 2*a*, 3*a*, and/or 4*a*. The PDCH spectrum can be acquired, for example, utilizing a dynode voltage +4000 Volts and a multiplier voltage of +1000 Volts. FIG. 5*b* represents the mass spectrum of methyl salicylate acquired using methods and/or circuitry configured as described in the positive ion detection mode, see, for example, FIGS. 2*b*, 3*b*, and/or 4*b*. The methyl salicylate spectrum can be acquired, for example, utilizing a dynode voltage of −4000 Volts and a multiplier voltage of +1000 Volts.

What is claimed is:

1. An ion detection method comprising:

providing an electron multiplier detector, the detector being operatively aligned to receive charged species directly from a dynode, wherein the dynode is coupled to a power source and operatively aligned to receive both first and second ions from an ion source via a mass separator;

applying a first voltage between the power source and the dynode;

contacting the dynode with the first ions to create a first charged species;

after applying the first voltage, applying a second voltage between the power source and the dynode, wherein the second voltage does not equal the first voltage;

contacting the dynode with the second ions to create a second charged species; and detecting both the first and second charged species.

2. The method of claim 1 wherein the detector, dynode, ion source, mass separator, and power source are components of a field portable mass spectrometer.

3. The method of claim 2 wherein the detector is coupled to processing circuitry of the mass spectrometer.

4. The method of claim 1 wherein the power source comprises two separate single-channel ground-referenced power supplies and the first voltage is supplied from one power supply and the second voltage is supplied from the other power supply.

5. The method of claim 1 further comprising generating analytical data, the analytical data comprising an abundance of the charged species detected associated with the voltage applied between the power source and the dynode.

6. The instrument circuitry of claim 1 wherein the power source is portable.

7. The instrument circuitry of claim 1 wherein the power source comprises a single dual-channel ground-referenced power supply.

8. The instrument circuitry of claim 1 wherein the power source comprises a single dual-channel floating power supply.

9. A mass spectrometry analysis method comprising:

ionizing a sample to form both first and second ions according to an ionization parameter, the first and second ions having different polarities;

sorting the ions by mass-to-charge ratio according to a mass separation parameter; and detecting the sorted ions using a dynode configured according to an ion detection parameter, the ion detection parameter comprising first and second dynode values associated with first and second time values, wherein the detecting comprises acquiring a sample data set comprising a first abundance of ions acquired during the first time value and a second abundance of ions acquired during the second time value.

10. The method of claim 9 wherein the dynode is a component of a field portable mass spectrometer.

11. The method of claim 9 wherein the ionization, mass separation, and detection parameters are associated with one another.

12. The method of claim 9 wherein the ionizing the sample comprises exposing the sample to chemical ionization and the ionization parameter includes the chemical ionization species of the chemical ionization.

13. The method of claim 9 wherein the sorting the ions comprises providing the ions to an ion trap and the mass separation parameter includes the waveform of the ion trap.

* * * * *

UNITED STATES PATENT AND TRADEMARK OFFICE

CERTIFICATE OF CORRECTION

PATENT NO. : 7,576,324 B2
APPLICATION NO. : 10/570717
DATED : August 18, 2009
INVENTOR(S) : John Grossenbacher et al.

It is certified that error appears in the above-identified patent and that said Letters Patent is hereby corrected as shown below:

Column 8, line 27 – Replace "a dynode voltage +4000 Volts" with -- a dynode voltage of +4000 Volts --

Signed and Sealed this
Seventeenth Day of May, 2011

David J. Kappos

David J. Kappos
*Director of the United States Patent and Trademark Office*